United States Patent [19]

Brunet

[11] Patent Number: 4,985,006

[45] Date of Patent: Jan. 15, 1991

[54] AQUATIC RECREATIONAL EQUIPMENT

[76] Inventor: Roberto L. Brunet, Ahuehuetes Nte. 918, Bosques de Las Lomas 11700 D.F., Mexico

[21] Appl. No.: 369,941

[22] Filed: Jun. 22, 1989

[51] Int. Cl.[5] ..... B63B 35/83

[52] U.S. Cl. ..... 441/076; 114/56

[58] Field of Search ..... 441/65, 68, 72, 73, 441/76, 77, 79; 114/56

[56] References Cited

U.S. PATENT DOCUMENTS

| | | | |
|---|---|---|---|
| 1,027,741 | 5/1912 | Lentz | 441/65 |
| 2,389,001 | 11/1945 | Schatz | 441/77 |
| 3,777,324 | 12/1973 | Jenkins | 441/77 |
| 4,320,905 | 3/1982 | Andrew | 441/65 X |

*Primary Examiner*—Sherman Basinger

*Attorney, Agent, or Firm*—Richard C. Litman

[57] ABSTRACT

Aquatic recreational equipment for facilitating rhythmic movement on water surfaces by manual propulsion, including a pair of hydrodynamically designed flotation skis. Each ski is integrally constructed of component parts comprising a ski-shaped member, a sealed buoyant chamber and a fixed keel, with an adjustable boot secured to the ski member. The buoyant chamber is provided with lateral surfaces defining ridges or shoulders and the cross-sectional areas of the buoyant chamber are such that stability and maneuverability of the flotation ski are maximized.

9 Claims, 2 Drawing Sheets

AQUATIC RECREATIONAL EQUIPMENT

BACKGROUND OF THE INVENTION

1. Field of the Invention

This invention relates to aquatic recreational equipment for movement over water surfaces and more particularly to a pair of hydrodynamically designed flotation skis to facilitate rhythmic movements on the surface of water by manual propulsion.

2. Description of the Prior Art

It is well-known that rhythmic movements performed on the surface of water without the use of towing by a motor boat may be accomplished by manually powered buoyant equipment designed for attachment to the feet of the user. It is also known that a pair of propulsion sticks or poles may be used in conjunction with this buoyant equipment to aid the user in simulating such characteristic movements as walking, gliding and skating on the water surface.

Aquatic devices of the above type have had the disadvantages of being cumbersome and difficult to maneuver and, accordingly, have not found widespread use among water sports enthusiasts. In recent years, various attempts have been made to optimize stability and maneuverability of these aquatic devices and most such attempts have centered on overall equipment configuration and material of construction. One of the more successful of such towless aquatic equipments for movement on water surfaces is described in U.S. Pat. No. 4,599,072 to Pollini et al. This patent discloses equipment comprising a pair of flexible shoes for accommodating a user's feet integral with floating skis, each formed of at least two sections interconnected by an articulated joint. A movable fin is pivotally mounted to the frontal section of each floating ski and two fixed fins are attached to the rear section. However, such an arrangement, while providing greater freedom of movement as far as the user's feet are concerned, presents poor longitudinal stability of the equipment during its movement through the water. Accordingly, only persons with considerable agility and balance are able to employ this prior art equipment to perform even such simple maneuvers on the water surface as walking or strolling without slippage. Further, without the aid of propulsion poles the patented equipment is not sufficiently buoyant to support the weight of the user when not in motion.

Until recently little or no improvement has been made in the construction and contouring of the bottom surface of flotation skis. A recent construction incorporates a plurality of curved-shaped ribs extending transversely over most of the bottom surface of such aquatic equipment, as more fully described in U.S. Pat. No. 4,527,984 to Gilbert. However, the disclosed construction restricts the maneuverability of the user to a forward movement and a pair of oaring sticks must be used in conjunction with the flotation skis in order to facilitate advancement as well as balance over water surfaces.

It is, accordingly, a primary object of the present invention to provide towless aquatic recreational equipment having enhanced stability and maneuverability for enabling rhythmic movements on the surface of water.

A further object of the present invention is to provide an improved pair of flotation skis which is designed to minimize drag when moving through the water and to maximize its buoyancy volume in order to stably support the weight of the user when not in motion.

It is among the further objects of the present invention to provide an improved hydrodynamic design for a pair of towless flotation skis which allows the user, with the aid of a pair of propulsion paddles, to perform a number of characteristic movements on water surfaces never before effectively attained with conventional equipment of this type. The design of the flotation skis ensures stability during operation and permits athletic water exercises to be performed by persons of average physical strength, agility or stamina. Also, each ski of the present invention is designed for obtaining optimum speed and for allowing a greater freedom of movement to the user while lessening fatigue.

SUMMARY OF THE INVENTION

These and other objects are accomplished in accordance with the embodiments of the present invention which generally provide a pair of hydrodynamically designed flotation skis, wherein each ski comprises an elongated ski-shaped member having an upper surface and a bottom surface; a sealed buoyant chamber or hull extending substantially the length of the ski member and integrally attached to a portion of the bottom surface thereof; a keel which extends along the center of the buoyant chamber and affixably projects therefrom; and an adjustable boot secured to the upper surface of the ski member for receiving a user's foot.

The sealed buoyant chamber or hull is contoured to prevent the occurrence of turbulence and minimize drag. Its configuration is a function of the weight to be supported. Therefore, the sealed chamber must be of sufficient volume to remain afloat and support the weight of the user by displacing the appropriate amount of water. The keel serves to stabilize the ski and may be separately fastened to the buoyant chamber or integral therewith to form a flotation ski according the present invention having an unitary construction.

The relative dimensions and weights of the above-described component parts of the flotation skis according to the present invention may vary depending on the weight to be supported and the degree of governability desired and can be readily determined by the application of conventional engineering principles. Hence, precise weights and exact dimensions of the ski member, buoyant chamber and keel have been calculated by well-known nautical computations, such as displacement ratios, centers of flotation and equilibrium coefficients to construct flotation skis according to the present invention for use in a variety of water sporting activities.

While some of the more salient features of the present invention have been pointed out hereinabove, these and other features, advantages and objects may be more fully appreciated by reference to the following description in which there is illustrated and described preferred embodiments of the invention.

DETAILED DESCRIPTION OF THE PREFERRED EMBODIMENTS

Figure 1:
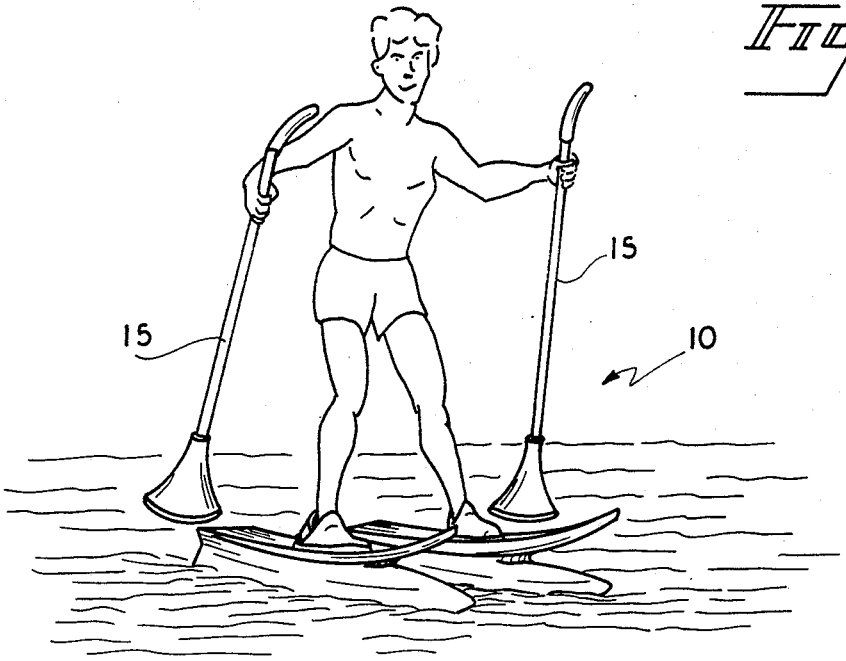
FIG. 1 is a pictorial view of the flotation skis of the invention in use with a pair of propulsion paddles.

With reference to the drawings, wherein like reference characters designate like or corresponding parts throughout the several views, there is shown a flotation ski embodying the present invention, generally indicated as 10, comprising an elongated ski-shaped member 30. This member includes a generally flat upper surface 32 measuring approximately 4–6 feet in length and an upwardly turned front end 34 which defines a rounded undersurface extending from the frontal section thereof. By virtue of this construction, a substantial length of a bottom surface 36 rides out of the water, depending on the level of displacement, thus lessening the area of water contact and frictional drag.

Adjustable boot 20 is secured to upper surface 32 by any suitable mounting means and may be approximately located medially of ski member 30. Boot 20 is made of resilient material and is of the type construction similar to that used for conventional tow skis. The resilient boot comprises molded sections 22 and 24 which are designed to conform to the front and rear portions of the user's foot, respectively. Section 22 and/or section 24 may be stationary or slidably mounted on rails or guides (not shown) secured independently of one another to the flat upper surface 32 of the ski member and locked into position by any suitable fastening means. More specifically, the rails or guides may be laterally disposed along boot 20 and are provided with a plurality of corresponding apertures or slots (not illustrated) which permit locking of rear and/or front molded boot sections 22 and 24 thereto. These positioning and locking means are well-known, per se, in the art of tow water skis.

As can be appreciated, boot sections 22 and 24 can be adjusted to realize both a given foot size and a given weight distribution. Thus, foot size can be varied by movement of either the rear or front boot section by the degree necessary to accommodate the user's foot. Weight distribution, in turn, can be varied by then moving both front and rear sections simultaneously to the proper position for accurate weight distribution to provide maximum control. Also, flexible boot 20 conveniently permits ready disengagement of the user's foot therefrom, especially in the event of emergency.

Figure 3:
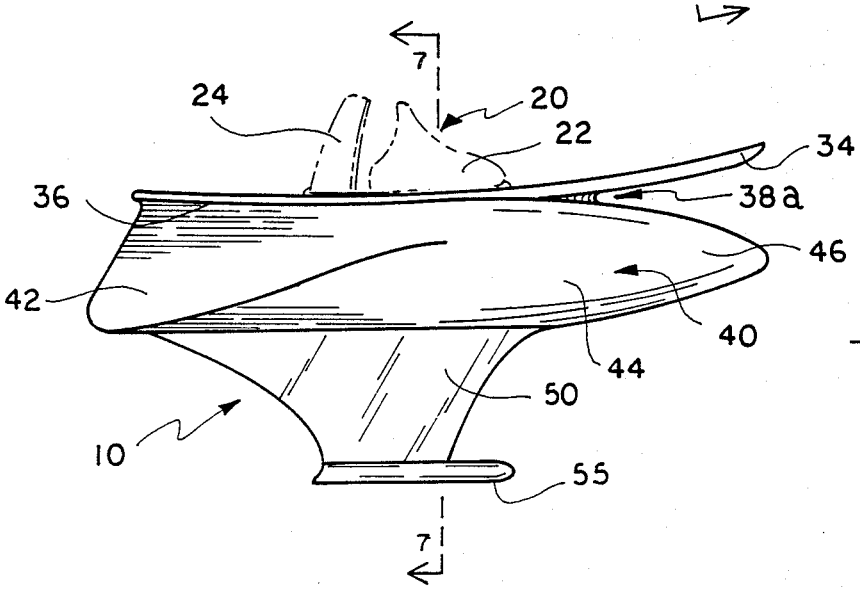
FIG. 3 is a side elevational view of a flotation ski illustrating an alternative buoyant chamber and keel construction according to the present invention.
Figure 4:
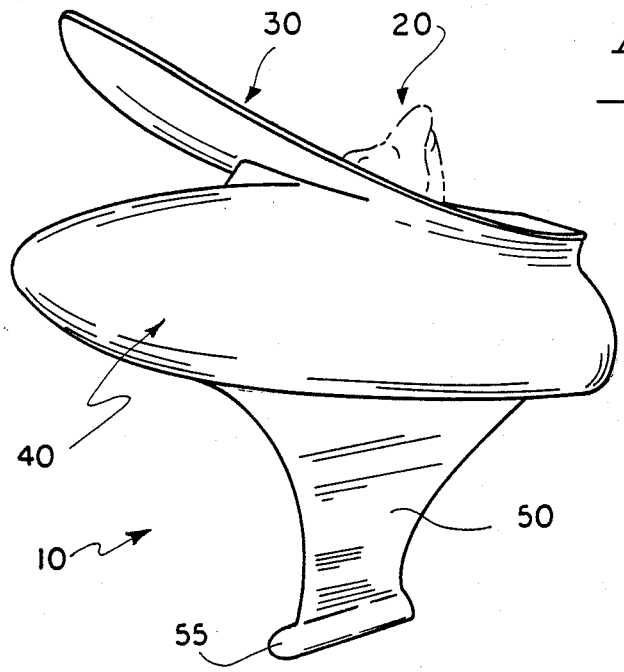
FIG. 4 is a perspective view of the flotation ski of FIG. 3.
Figure 5:
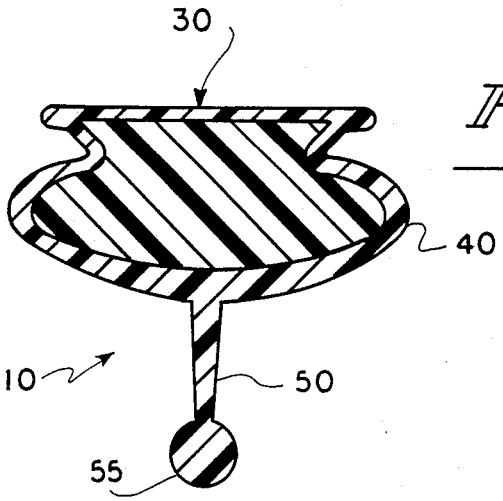
FIG. 5 is a cross-sectional view taken along line 6—6 of FIG. 2.
Figure 6:
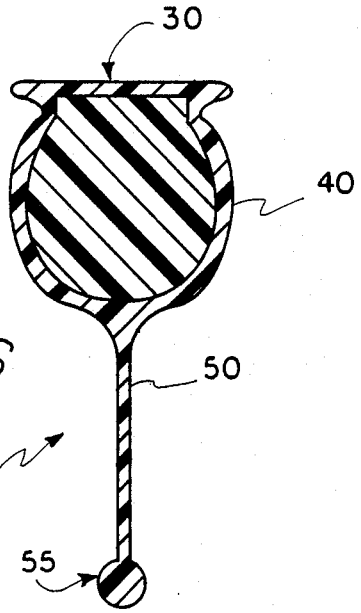
FIG. 6 is a cross-sectional view taken along line 7—7 of FIG. 3.

Buoyant chamber 40 consists of a sealed cylindrical hull having a stern section 42 and a mid-hull section 44 integrally connected to bottom surface 36, and a conical-shaped bow section 46 protruding therefrom. Bow section 46 and upwardly turned front end 34 of the ski member are constructed so as to define therebetween a space **38*a* roughly in the shape of a backward V, whereby the resistance to forward movement of flotation ski 10 through the water is substantially reduced. As illustrated in FIG. 3, each of the side surfaces of buoyant chamber 40 defines a ridge 48 which inclines upwardly from the sternmost end of section 42 and extends laterally along mid-hull section 44. These lateral surfaces are of great help in giving the flotation ski 10 a planing attitude for gliding over the water when performing certain maneuvers in which the hull is not completely immersed in the water, such as skating. Stern section 42 has a definitive elliptical cross-sectional configuration in comparison to the more rounded cross-sectional shape of bow section 42**, whereby the resistance to rearward movement is substantially reduced.

Figure 2:
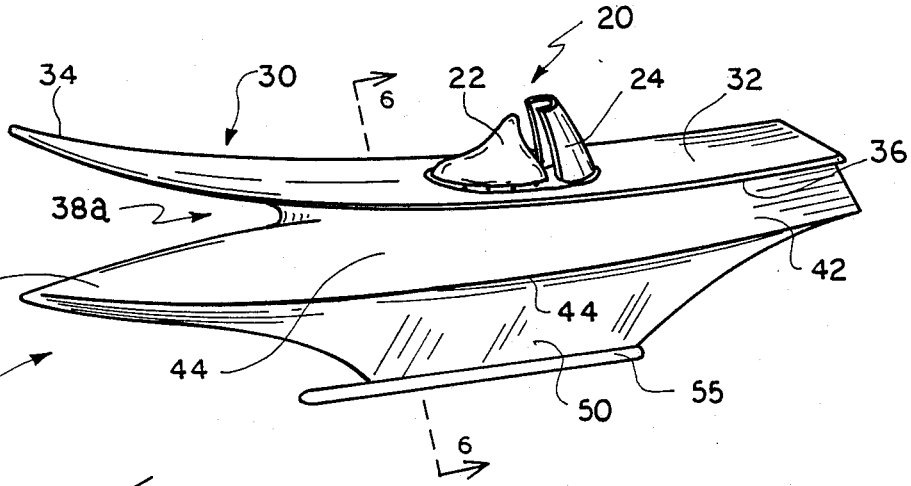
FIG. 2 is a perspective view of a flotation ski illustrating a buoyant chamber and keel construction according to the present invention.

FIG. 2 illustrates a streamlined hull design, wherein each of the side surfaces defines a shoulder 49 which extends along the length of the buoyant chamber. These lateral surfaces greatly increase the buoyancy volume of the hull as the hull recedes below the waterline during standing or movement by application of the principle of Archimedean buoyancy. It should also be noted that the buoyancy is proportionally increased as the hull recedes and the center of buoyancy of the flotation ski remains constant upon displacement when it is in the horizontal position. The cross-sectional shape of the stern section 42, mid-hull section 44 and bow section 46 are relatively elliptical to enhance the longitudinal and transversal stability of the flotation skis during movement in the water and sufficiently support a relatively increased amount of weight.

Another important structural feature of the underside of the flotation ski is fin-like keel 50 which extends centrally of buoyant chamber 40 and rigidly affixed thereto. In the illustrated embodiment the fin keel, whose planar surfaces decreases in area upon vertical extension, has a relatively narrow cross-section and is molded as an integral part of the hull or buoyant chamber. It will be appreciated that the keel 50 may be formed in a variety of ways and have a variety of weights, depending on the total weight that the ski supports. Fin keel 50 vertically projects along the longitudinal axis of symmetry of stern section 42 and mid-hull section 44 and extends into the water sufficient enough to prevent capsizing and also prevents any potential lateral slippage through the water to provide directional stability.

As mentioned above, the fin keel 50 is molded so that it smoothly joins the pertinent sections of the buoyant chamber so as to present a smooth, low friction surface as the flotation ski travels through the water. The keel places a relatively large surface area of rigid material in the water so that even while one flotation ski is lifted out of the water, keel 50 continues to provide stability by improving the effect of hydrodynamic penetration. Preferably, the terminal portion of keel 50 consists of an elongated ballast member 55 secured thereto. Ballast 55 is most suitably molded as an integral part of the terminal portion of the keel 50 to improve the stability and control the draft of the buoyancy chamber 40 without adversely affecting maneuverability. Ballast member 55 may be weighted by filling it with lead or any other suitable heavy material.

The flotation ski 10 may be constructed in any manner conventional within the boating industry. One preferred method of construction would be to provide a unitary external shell comprising all the above described component parts, except the adjustable boot 20. The shell may be made of plastic or Fiberglas, for example, and an internal filling of foam material for the buoyancy chamber 40 is provided. This will make the buoyancy chamber exceedingly light and also assure that the ski will not sink. As a result, it will be possible to use the flotation ski as a life raft in the event of emergency. As an alternative, the ski member 30 can be made of waterproof plywood or any other convenient material, the keel may consist of a heavy plate material and the external surface of the flotation ski coated with a resin material, and wherein the buoyancy chamber 40 is sealingly hollow.

By way of example, to support a user weighting about 100 pounds, each flotation ski 10 as illustrated in FIG. 2 has a displacement of about 75 pounds and will have the following dimensions: the buoyant chamber or hull 40 should have a length of about 4 feet and a diameter of about 8 inches; the length of ski member 30 will be about 4-4½ feet and the weight of fin keel 50, including weighted ballast 55, is about 15% of the displacement or about 11 pounds. It will be appreciated that the hull and/or keel may be configured in alternative hydrodynamic shapes to accommodate variations in supported weights. FIG. 2 illustrates one such possible design which has been found to be effective for supporting a user weighting approximately 175 pounds.

In operation, the construction and contouring of the bottom surface of the flotation skis according to the present invention provides for outstanding performance when used in conjunction with a pair of propulsion paddles 15, as best illustrated in FIG. 1. Hence, a skiing movement in a forward direction on the water surface may be accomplished by repetitively displacing a certain amount of water by pushing paddles 15 rearwardly with both skis engaged in the water. By intermittently pausing between this repetitive motion, the user is able to glide on the surface of the water, movement being facilitated by said paddles 15. Also, since an effective amount of buoyancy and stability is provided for each of the flotation skis of the present invention, a variety of athletic exercises and rhythmic movements, such as walking, aerobics and skating, may be skillfully performed by a user having average agility.

It is understood that the foregoing description is merely illustrative of the many possible specific embodiments which represent constructions and applications of the present invention. Numerous and varied other changes can readily be devised in accordance with the principles of the present invention without departing from the spirit and scope of the invention.

I claim:

1. Aquatic recreational equipment for facilitating rhythmic movement on water surface by manual propulsion, said equipment including a pair of hydrodynamically designed flotation skis, wherein each ski comprises:

an elongated ski-shaped member having a generally flat upper surface which defines an upwardly turned front end and a bottom surface;

a sealed buoyant hull extending substantially the length of said elongated ski-shaped member and including a stern section and a mid-hull section integrally attached to said bottom surface of the elongated ski-shaped member, and a protruding conical-shaped bow section, whereby said bow section and said upwardly turned front end of the ski member define a space therebetween;

a keel extending along the center of said sealed buoyant hull and rigidly affixed thereto; and an adjustable boot secured to said flat upper surface of the ski-shaped member and positioned medially thereof.

2. The equipment according to claim 1, wherein said sealed buoyant hull includes lateral surfaces defining a ridge which inclines upwardly from a sternmost end of said stern section and extends along said mid-hull section.

3. The equipment according to claim 1, wherein said stern section has an elliptical cross-sectional configuration and the bow section of said buoyant hull has a circular cross-sectional shape.

4. The equipment according to claim 1, wherein said sealed buoyant hull includes lateral surfaces defining a shoulder which extends along the length of the hull.

5. The equipment according to claim 1, wherein said stern section, said mid-hull section and protruding bow section of the buoyant hull has a relatively elliptical cross-sectional shape.

6. The equipment according to claim 1, wherein said keel comprises a fin keel.

7. The equipment according to claim 1, wherein said keel includes a terminal portion having an elongated ballast secured thereto.

8. The equipment according to claim 7, wherein said elongated ballast is molded as an integral part of said terminal portion of the keel.

9. The equipment according to claim 1, wherein said ski is integrally constructed to provide a unitary external shell comprising said elongated ski-shaped member, said sealed buoyant hull and said keel.

* * * * *